US005992288A

United States Patent [19]

Barnes

[11] Patent Number: 5,992,288

[45] Date of Patent: Nov. 30, 1999

[54] KNOWLEDGE BASED AUTOMATIC THREAT EVALUATION AND WEAPON ASSIGNMENT

[75] Inventor: Gregory R. Barnes, La Palma, Calif.

[73] Assignee: Raytheon Company, Lexington, Mass.

[21] Appl. No.: 08/962,792

[22] Filed: Nov. 3, 1997

[51] Int. Cl.[6] ..... F41G 9/00

[52] U.S. Cl. ..... 89/1.11; 364/148.01

[58] Field of Search ..... 364/148.01; 89/1.11, 89/41.05, 41.07

[56] References Cited

U.S. PATENT DOCUMENTS

| | | | |
|---|---|---|---|
| 4,647,759 | 3/1987 | Worsham et al. | 235/411 |
| 5,153,366 | 10/1992 | Lucas | 89/1.11 |
| 5,206,452 | 4/1993 | Stampler et al. | 89/1.11 |
| 5,282,013 | 1/1994 | Gregoris et al. | 356/4 |
| 5,511,218 | 4/1996 | Castelaz | 364/232.3 |
| 5,662,291 | 9/1997 | Sepp et al. | 89/1.11 |

FOREIGN PATENT DOCUMENTS

| | | |
|---|---|---|
| 3818444 | 5/1988 | Germany . |
| 5012293 | 1/1993 | Japan . |
| 9519545 | 7/1995 | WIPO . |
| 9809131 | 3/1998 | WIPO . |

OTHER PUBLICATIONS

Patent Abstracts of Japan, Weapon Arrangement Automatic Computing System, Publication No. 05012293, Publication Date 22–01–93, Inventor Hayashi Tomihiko, one page.

Search report from the EPO in connection with PCT application PCT/US98/22350, dated 2/4/99, 7 pages.

*Primary Examiner*—Stephen M. Johnson

*Attorney, Agent, or Firm*—Daly, Crowley & Mofford LLP

[57] ABSTRACT

A knowledge based threat evaluation and weapon assignment (TEWA) system and method. Upon identification of a hostile class track, if the track is outside national boundaries or defensive zones, a threat index is calculated to evaluate the threat. The index considers track speed, heading, altitude, and any known amplifying information such as flight size, airframe type, weapons load or missile type. If a threat enters a defensive zone, it becomes a target. Automatically a trial intercept calculation (TIC) will be calculated against the target. The TIC will utilize resources allocated to the zone; and with the aid of a zone target priority knowledge database and a target/weapon pairing database, the TIC will select the best available weapon to neutralize the target. The result of the TIC will be a weapon recommendation to the weapon's controller.

19 Claims, 6 Drawing Sheets

| Target Type | Priority 1 | Weapon 2 | Types 3 | • • • | Zone 4 Target Priority |
|---|---|---|---|---|---|
| MIG X-L3 | F16-L1 | F16-L2 | IHAWK | • • • | 2 |
| MIG Y | F16-L2 | F16-L1 | PATRIOT | • • • | 1 |
| HELO Z | F16-L2 | F16-L1 | IHAWK | • • • | 3 |
| • • • | | | | | |
| Unknown | F16-L2 | F16-L1 | IHAWK | • • • | 4 |

List All Possible Target Types

40

Note: Table Required for Each Zone

| Target Type | Zone 1 Priority | Zone 2 Priority | Zone 3 Priority | Zone 4 Priority |
|---|---|---|---|---|
| MIG X-L3* | 2 | 1 | • | • |
| MIG Y | 1 | 2 | • | • |
| HELO Z | 3 | 3 | • | • |
| • • • | | | | |
| Unknown | 4 | 3 | • | • |

List All Possible Target Types

* Ln Designates Type of Weapons Load

20

FIG. 3

FIG. 4

| Target Type | Priority 1 | Weapon 2 | Types 3 | • • • |
|---|---|---|---|---|
| MIG X-L3 | F16-L1 | F16-L2 | IHAWK | • • • |
| MIG Y | F16-L2 | F16-L1 | PATRIOT | • • • |
| HELO Z | F16-L2 | F16-L1 | IHAWK | • • • |
| • • • | | | | |
| Unknown | F16-L2 | F16-L1 | IHAWK | • • • |

List All Possible Target Types

30

List All Possible Weapon Types Capable of Destroying the Target

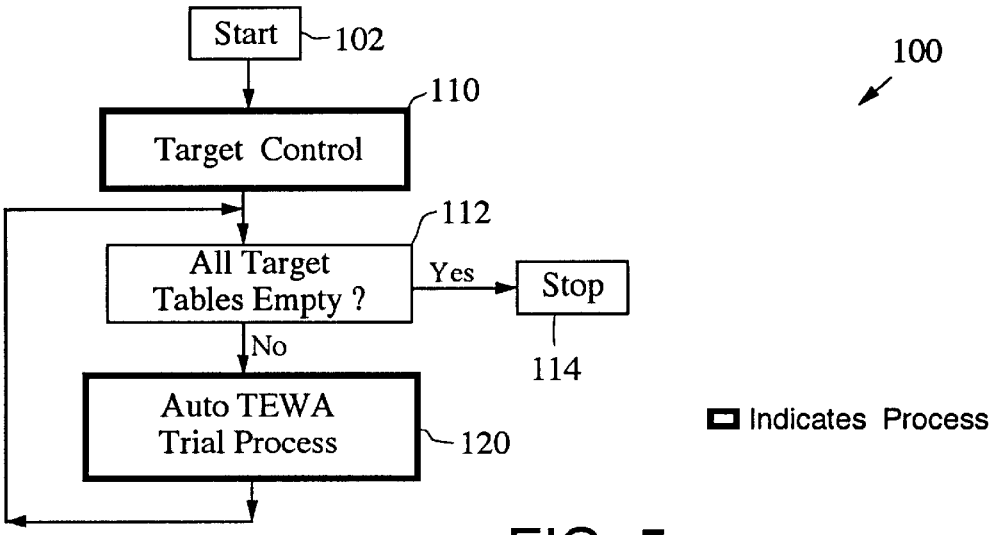
FIG. 5
FIG. 6
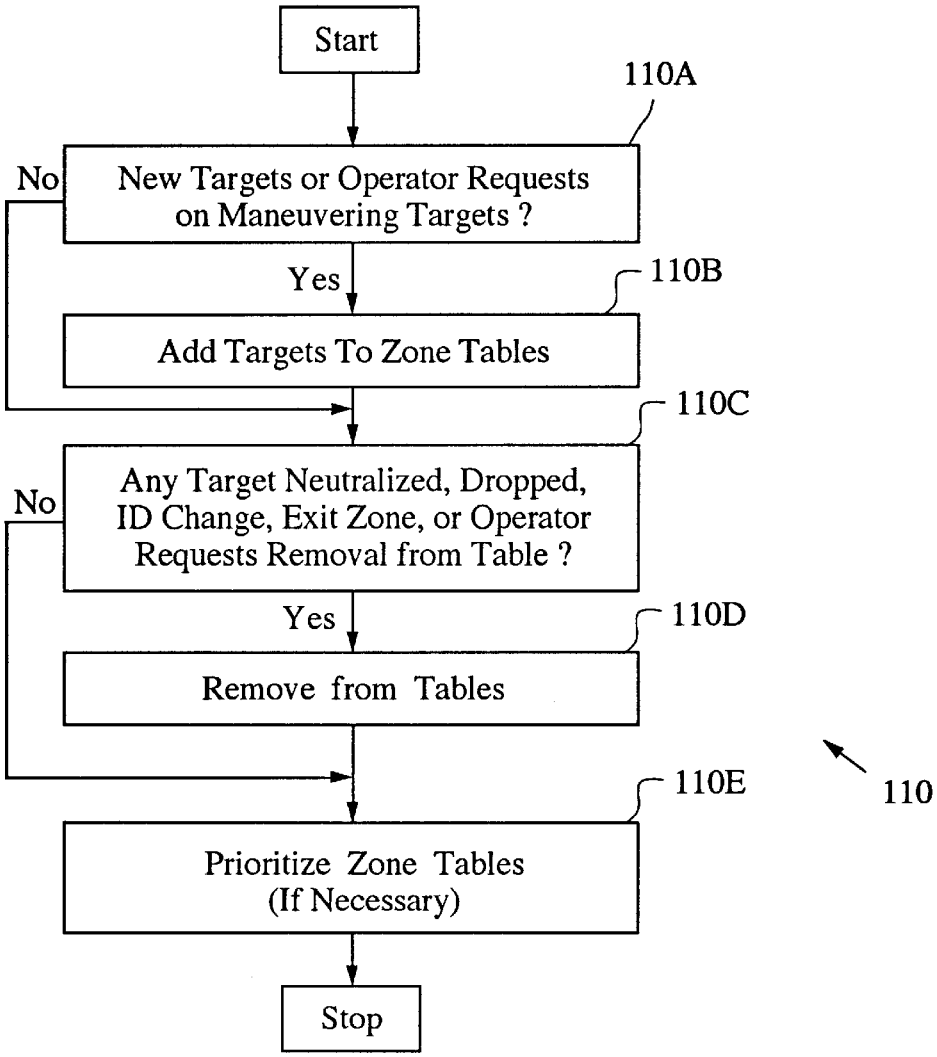

FIG. 7

| Target Type | Priority 1 | Weapon 2 | Types 3 | • • • | Zone 4 Target Priority |
|---|---|---|---|---|---|
| MIG X-L3 | F16-L1 | F16-L2 | IHAWK | • • • | 2 |
| MIG Y | F16-L2 | F16-L1 | PATRIOT | • • • | 1 |
| HELO Z | F16-L2 | F16-L1 | IHAWK | • • • | 3 |
| • • • | | | | | |
| Unknown | F16-L2 | F16-L1 | IHAWK | • • • | 4 |

List All Possible Target Types

40

Note: Table Required for Each Zone

KNOWLEDGE BASED AUTOMATIC THREAT EVALUATION AND WEAPON ASSIGNMENT

TECHNICAL FIELD OF THE INVENTION

This invention relates to automatic threat evaluation and weapons assignment systems, and more particularly to such a system which incorporates knowledge data bases or expert system techniques in the solution.

BACKGROUND OF THE INVENTION

Automatic threat evaluation and weapon assignment (TEWA) has traditionally been approached in the following representative manner. If an unassigned hostile enters the system, a threat index is computed. The threat index rates the hostile with respect to defended areas and, if a threshold is attained, a trial intercept calculation (TIC) is triggered. There may be several defended areas or the whole country could be considered as one large defended area. The TIC performed typically selects from a list of weapon resources (interceptors and surface to air missiles (SAM) for example), and recommends a set of weapons, ordered by the shortest time to intercept, to engage the target. The intercept problem solved by TIC processing is the time-space problem of placing the target and weapon at the same point in time and space. Once a TIC has been calculated against a target, the target is no longer evaluated as a threat, since a recommendation has been made to the operator, and automatic TEWA processing is terminated for the target.

This traditional process has shortcomings, and in particular does not address several problems. If information regarding the target (such as type and weapons load) is known, this information is not utilized by TIC processing. The TIC recommends the shortest time to intercept solutions regardless of the target type or defensive weapon type. Hence, it is possible to recommend an interceptor with a weapons load which has virtually no chance of destroying the target. It would be desirable to pair targets with the type of defensive weapons which have a likelihood of destroying the target.

If several hostiles have entered the system, TIC processing does not consider the multiple target problem. That is, TICs are performed one at a time on a target by target basis. Thus, the TIC may recommend a weapon to intercept target number 1 whereas that weapon is most effective against target number 2. In such a situation, it would be desirable to recommend a weapon against the target number 2.

Another problem is that conventional automatic threat evaluation does not account for target maneuver. Consequently upon TIC completion, if the target has maneuvered, the TIC may no longer be valid for the target. Moreover, once a TIC is completed, the target is no longer eligible for automatic threat evaluation processing. This is undesirable in the event of a missed intercept.

SUMMARY OF THE INVENTION

A method for automatic weapon assignment is described, and in an exemplary embodiment comprises the steps of:

(i) providing a database of possible mobile target types, said database including for each target type a set of particular weapon types in a prioritized arrangement, the target types being assigned a priority ranking;

(ii) providing a target table of targets detected within a protected area;

(iii) selecting a detected target in the target table having a highest priority ranking;

(iv) performing a automatic weapon assignment process on the selected target, the process including selecting an available weapon for use against the target according to the prioritized arrangement, and performing a trial intercept calculation on the target using the selected weapon.

The automatic weapon assignment process of step (iv) further comprises determining whether the selected target has been neutralized by the selected weapon, selecting another available weapon for use against the target according to the prioritized arrangement, and performing a trial intercept calculation on the selected target using the next available weapon.

The method can further include the step of adding newly detected targets within the protected area to the table, and removing from the table any targets which have been neutralized or which exit the protected area.

According to a further aspect of the invention, the protected area is divided into defensive zones, and separate target tables and zone target priority knowledge databases are maintained and used.

BRIEF DESCRIPTION OF THE DRAWING

These and other features and advantages of the present invention will become more apparent from the following detailed description of an exemplary embodiment thereof, as illustrated in the accompanying drawings, in which:

FIG. 3 illustrates a zone target priority database in accordance with the invention.

FIG. 4 illustrates a target/weapon pairing knowledge database in accordance with the invention.

FIG. 5 is a simplified flow diagram illustrating an automatic TEWA algorithm in accordance with the invention.

FIG. 6 is a flow diagram illustrating the target control processing step of the algorithm of FIG. 5.

FIG. 7 is an exemplary zone target table in accordance with the invention.

DETAILED DESCRIPTION OF THE PREFERRED EMBODIMENT

The TEWA process is divided into two stages, according to one aspect of the invention. The first stage evaluates threats as they approach national boundaries. The second stage commences upon the threat entering any of a defined set of defensive zones. If target identification knowledge includes target type and weapons load, this is incorporated into the auto TEWA solution. If the threat includes multiple targets, the entire set of targets is considered. Events such as target maneuver, identity change, missed intercepts and effective engagements are also considered in accordance with a further aspect of the invention.

Figure 1:
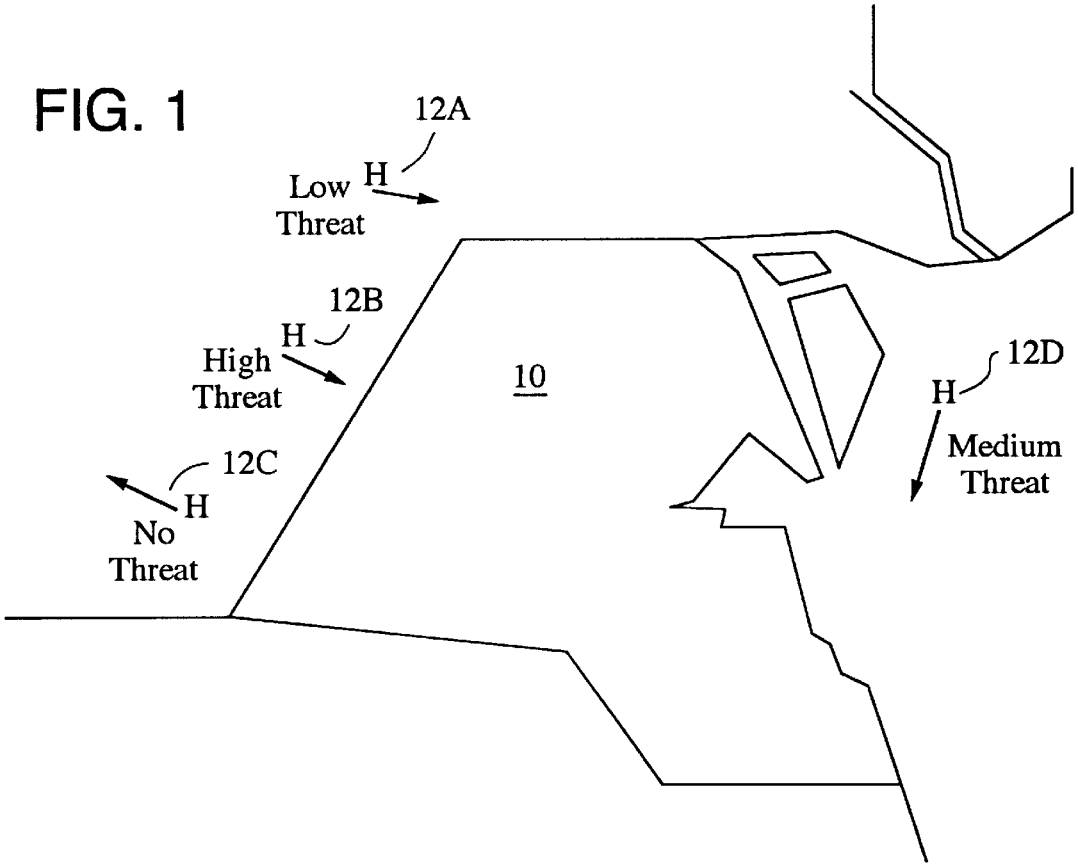
FIGS. 1 and 2 respectively illustrate the first and second stages of a TEWA problem.

First Stage FIG. 1 illustrates the first stage. Upon identification of a hostile class track, if the track is outside national boundaries or defensive zones, a threat index is calculated to evaluate the threat. The index considers track speed, heading, altitude and any known amplifying information such as flight size, airframe type, weapons load or missile type. In FIG. 1, the national area 10 has several hostile tracks 12A–12D adjacent its boundaries. Track 12A is classified as low threat, 12B as high threat, 12C as no threat, and 12D as medium threat.

Figure 2:
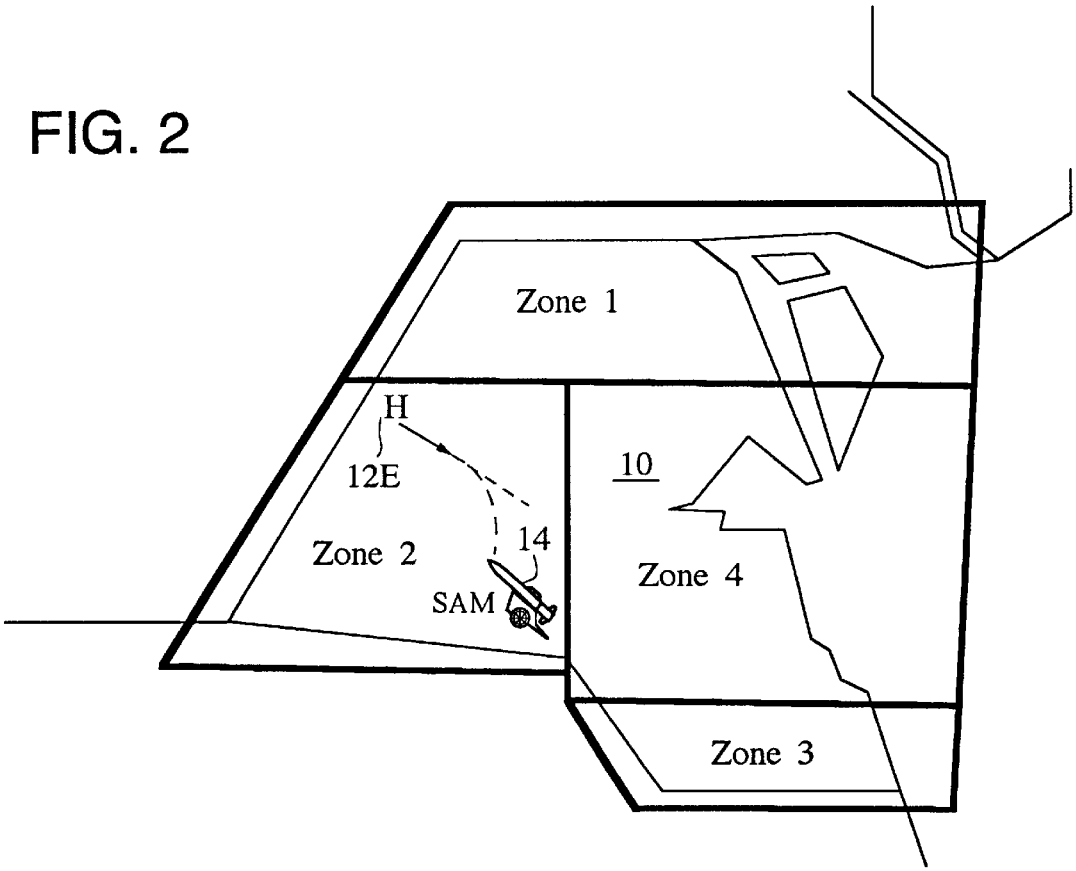

Second Stage FIG. 2 illustrates the second stage. If a threat enters a defensive zone, it becomes a target. In the example of FIG. 2, hostile track 12E has entered defensive zone 2 of the national area 10. Automatically, a trial intercept calculation (TIC) will be calculated against the target 12E. The TIC will utilize weapon resources allocated to the zone; and with the aid of a Zone Target Priority Knowledge Database and a Target/Weapon Pairing Knowledge Database (described below), the TIC will select the best available weapon to neutralize the target. The result of the TIC will be a weapon recommendation to the weapons controller. If the recommended weapon is a SAM, e.g. SAM 14, and the system is in automatic SAM engagement mode, a pending engagement will be created between the target and selected SAM fire unit. After a time delay, if no operator intervention occurs, the engage command will automatically be transmitted to the fire unit.

Defensive Zones Defensive zones are described by convex polygons. They can lie within the national boundaries or extend beyond national boundaries. For example, FIG. 2 shows defensive zones 1–4. Associated with each defensive zone are weapon resources allocated for zone defense. Weapons can include, for example, SAM sites, aircraft on station at designated Combat Air Patrol (CAP) points or squadrons at designated air bases. Also associated with each zone is a Zone Target Priority Knowledge Database.

Zone Target Priority Knowledge Database This database includes all known possible targets, including an unknown category, and a priority rating associated with each defensive zone. An example database 20 is illustrated in FIG. 3. The assigned priorities may vary as a function of the zone. This allows for the possibility that a target (e.g. of a specific type or with a given weapon load) may be more threatening, or more effective against assets, within the one zone or the other. If a threat or multiple threats enter a zone, the assigned priority indicates the order in which trial processing and, consequently, weapon resources will be allocated to each threat in TIC processing. For example, the first target type in the table of FIG. 3 is a MIG X-L3, where MIG X indicates an aircraft type and L3 indicates a particular type of weapons load. This target type is assigned a zone 1 priority rating of 2, a zone 2 priority of 1, and no priority for zones 3 and 4. A MIG Y aircraft is assigned a zone 1 priority of 1, a zone 2 priority of 2 and no priority for zones 3 and 4. A HELO Z, representing a helicopter type, is assigned a priority 3 for zones 1 and 2, and no rating for zones 3 and 4. The unknown target is assigned a zone 1 priority of 4, a zone 2 priority of 3, and no priority for zones 3 and 4.

Target/Weapon Pairing Knowledge Database This database pairs each weapon resource, in priority order, with each expected target type. This pairing represents the best weapon resource to be employed against the target type. FIG. 4 illustrates an exemplary target/weapon pairing knowledge database 30. In the first row of FIG. 4, the target type is MIG X-L3, the most effective weapon against this target is the F16-L1, the next most effective is the F16-L2, and the last priority is IHawk. The FIG-16 can represent an interceptor type, with L1 and L2 indicating types of weapons load. The IHAWK can represent a SAM type. Similarly, interceptor and SAM types are assigned priority ratings to each of the other target types. This knowledge is utilized in TIC processing.

Auto TEWA Algorithm An exemplary automatic TEWA algorithm 100 is represented in FIG. 5. This algorithm incorporates the Zone Target Priority Knowledge Database and the Target/Weapon Pairing Knowledge Database to select the highest priority target, from all targets within a zone, and pair it with the best weapon resource available for the zone. The algorithm examines all targets within a zone and accounts for target flight size. If targets become uncommitted, as a result of missed intercepts or ineffective SAM engagements, new trial intercepts will automatically be calculated against the targets. The auto TEWA algorithm includes the Target Control process 110 and the Auto TEWA Trial process 120. Thus, in a general top level sense, the auto TEWA algorithm 100 commences at step 102, and proceeds to the target control 110 to update the zone target table. (The target control process is more fully described below with respect to FIG. 6.) If all the target tables are determined to be empty (step 112), the algorithm stops. If all the target tables are not empty, processing proceeds to the Auto TEWA Trial Process (step 120), and subsequently branches back to step 112. (The process 120 is described more fully below with respect to FIG. 9.)

Target Control Target Control processing 110 creates and updates the Zone Target Table (FIG. 7), and is represented in FIG. 6. This process provides for events causing tracks to be added or removed from the table. Targets are added to the Zone Target Table (steps 110A, 110B) in the following cases:

1. A new uncommitted threat enters the zone.
2. The operator requests automatic trial processing on the target.
3. A target within the zone becomes uncommitted against (SAM broke engagement, intercept missed and operator recommits fight to another target or return to base).

Targets are removed from the Zone Target Table (steps 110C, 110D) in the following cases:

1. The target is committed against.
2. Weapons have been recommended against the entire target flight size.
3. Operator requests removal.
4. Target is identified as friendly.
5. Target exits zone. (In this case, if it enters another zone, it will be added to that zone's table).
6. Target is neutralized or dropped.

The Zone Target Table is re-prioritized (step 110E) in the event that the type is modified for a target in the table. For example, if a MIG X-L3 is updated to a MIG Y or an Unknown is identified.

Zone Target Table FIG. 7 shows an exemplary Zone Target Table 40. This table is constructed and updated for each defensive zone. As threats enter a zone, they are automatically added to the table and prioritized. This table defines the target order for TIC processing and the weapon allocation to be employed to place the best weapon against the highest priority target. Thus, for example, the first row of the table 40 lists the target type (MIG X-L3), the priority weapon types (first priority is the F16-L1, second is the F16-L2, third is the IHAWK, and so on), and the target priority for the particular zone, in this case zone 4 (second priority). All possible target types are listed in this table.

Operator Requests An operator may request that a target be made eligible or re-eligible for automatic TEWA processing for a variety of reasons. For example, once a trial has been completed on a target and a weapon recommendation made (for entire flight size), the trial processing will not perform further trials on the target. However, the target may begin to maneuver rendering the recommended weapon no longer effective against the target. Upon target maneuver, detected by the surveillance function, a target maneuver alert will be displayed for the target. The operator may request that automatic TEWA be performed against the target.

Figure 8:
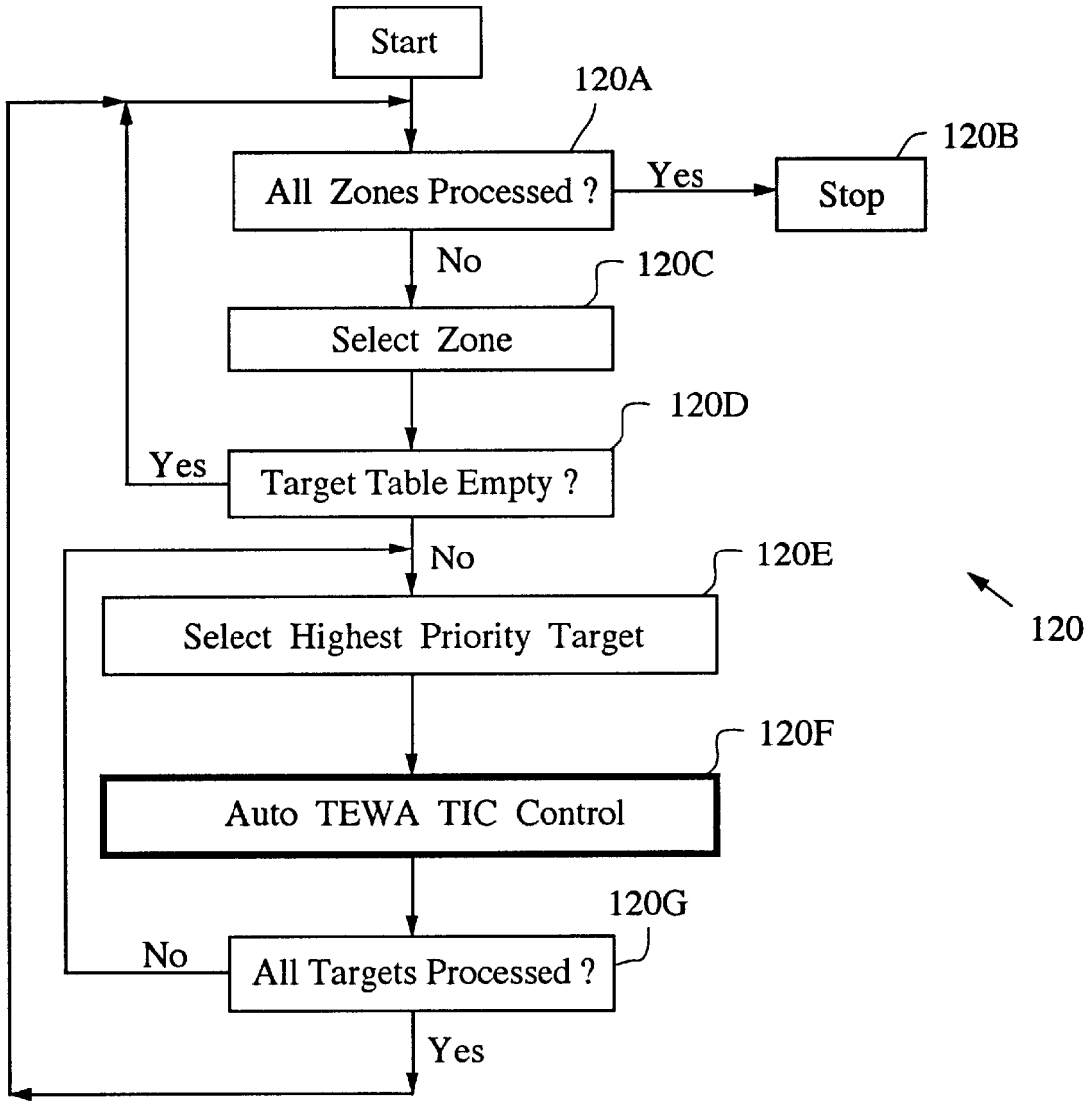
FIG. 8 is a flow diagram illustrating the automatic TEWA trial processing step of the algorithm of FIG. 5.

Auto TEWA Trial Processing Auto TEWA Trial processing 120 provides for processing a TIC against each target in the Zone Target Table. This is performed in all defensive zones. FIG. 8 illustrates this processing. The processing commences at step 120A, a decision block as to whether all zones have been processed. If affirmative, the processing is stopped at step 120B. If all zones have not been processed, a zone is selected at step 120C. If the target table for that zone is empty, processing branches back to step 120A. If the target table for the selected zone is not empty, then at step 120E the highest priority target for that zone is selected at step 120E using the zone target priority knowledge database of FIG. 3, and the Auto TEWA TIC Control process is performed at step 120F, described more fully in FIG. 9. After completion of the process 120F, step 120G returns the processing to step 120E if all targets in the selected zone have not been processed, or returns to step 120A if all targets have been processed.

Figure 9:
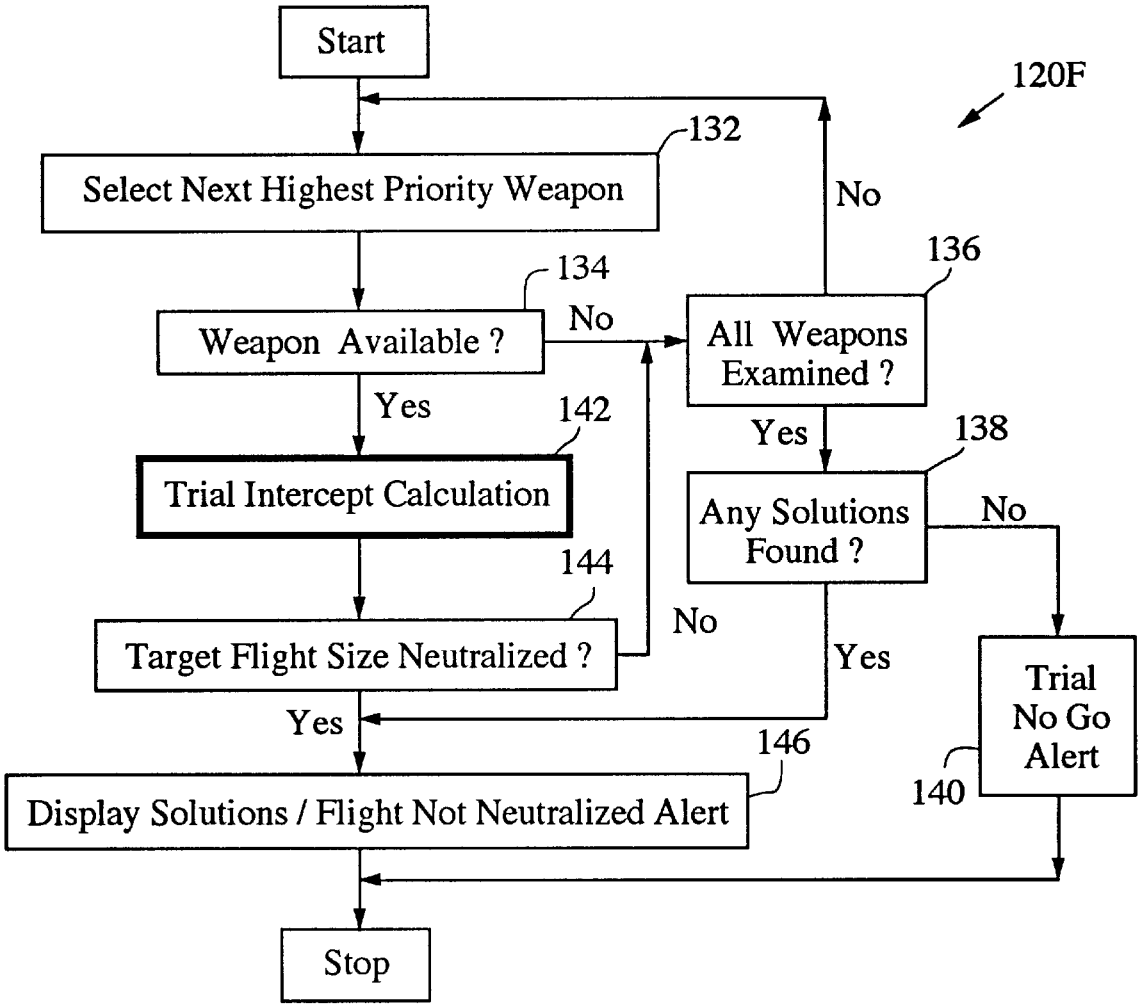
FIG. 9 is a flow diagram of the automatic TEWA trial intercept calculation (TIC) step comprising the process of FIG. 8.

Auto TEWA TIC Control Auto TEWA TIC Control (step 120F) provides for the actual trial intercept calculations after the highest priority target has been selected, and is illustrated in the flow diagram of FIG. 9. The actual trial calculations utilize the prioritized weapon resources from the zone target table and calculate whether the weapon can intercept the target. The processing pairs a weapon to each member of the target flight size. If enough weapons of one type are not available, the algorithm examines the next highest priority weapon. The process continues until all members of the flight size are accounted for (neutralized). If only a partial flight size can be neutralized, an unaccounted (flight not neutralized) alert is displayed to the operator along with the weapon recommendations for the successful intercept solutions. If no intercept solution is found, the operator is alerted by the Trial No Go alert. The target remains in the table and is reexamined as weapon resources become available. Weapon resources become available in the following manner.

1. A SAM site breaks engage with a target and reports a status of ready.
2. A weapons controller recommits a fight from an intercept mission to a combat air patrol mission.
3. The weapon availability at an air base, e.g., is updated to reflect additional aircraft are available.

Referring now to FIG. 9, at step 132, the next highest priority weapon for the selected target is selected, using the target/weapon pairing knowledge database of FIG. 4. If the weapon is not available (step 134), and if all the weapons have not been examined (step 136), operation loops back to step 132 to select the next highest priority weapon. If all the weapons have been examined (step 136), processing proceeds to step 138. Here, if no solutions have been found, a "trial No Go Alert" is established (step 140), and the processing stops. If a solution has been found, a "solutions/flight not neutralized" alert is displayed to the weapons operator (step 146), and the processing stops. If, at step 134, the selected weapon is available, a Trial Intercept Calculation is performed for that weapon asserted against the selected target. If (step 144) the TIC results in neutralizing the target flight size, processing proceeds to step 146. If the flight size is not neutralized by the TIC, operation loops back to step 136 to determine if other weapons are available.

The Auto TEWA process in accordance with the invention provides for:

1. Two stage threat evaluation;
2. If target identification and weapons load is known, the highest priority weapon to intercept the target;
3. Re-evaluation in the event of missed intercepts;
4. Re-evaluation in the event of target maneuver;
5. Solution of the multiple target problem.

The Target/Weapon Pairing Knowledge Database defines the highest priority, most effective, weapon to counter expected threats. This pairing is based solely upon weapon effectiveness against a target. All weapons capable of destroying the target are prioritized against the target. Some weapons may be equally effective against different targets and some target's priority may vary as a function of defensive zone. For these reasons, the Zone Target Priority Knowledge Database is introduced. The Auto TEWA algorithm processes targets in priority order. This insures that the best available weapon is paired with the highest priority target.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for automatic weapon assignment, comprising the steps of:

(i) providing a database of possible mobile target types, said database including for each said target type a set of particular weapon types in a prioritized arrangement, said target types being assigned a priority ranking;

(ii) providing a target table of targets detected within a protected area;

(iii) selecting a detected target in said target table having a highest priority ranking; and (iv) performing an automatic weapon assignment process on said selected target, said process including selecting an available weapon type for use against said target according to said prioritized arrangement, and performing a trial intercept calculation on said target using said selected weapon type.

2. The method of claim 1 wherein said automatic weapon assignment process of step (iv) further comprises determining whether said selected target has been neutralized by said selected weapon type, selecting another available weapon type for use against said target according to said prioritized arrangement, and performing a trial intercept calculation on said selected target using said another available weapon type.

3. The method of claim 1, further comprising the step of adding newly detected targets within said protected area to said table, and removing from said table any targets which have been neutralized or which exit said protected area.

4. The method of claim 3 further comprising the step of adding to said table targets which become uncommitted against.

5. The method of claim 3 further comprising the step of removing from said table targets which become committed against and targets which are identified as friendly.

6. The method of claim 1 wherein said mobile targets are airborne targets.

7. The method of claim 1 wherein said database providing step comprises the step of assigning said target types a priority ranking as a function of at least one of: said protected area, a track speed, a heading, an altitude, a flight size, an airframe type, and a weapons load associated with said target types.

8. The method of claim 1 wherein said prioritized arrangement of said set of weapon types is a function of the effectiveness of each said weapon types in neutralizing each said target type.

9. The method of claim 1 wherein the step of performing a trial intercept calculation on said target using said selected weapon comprises the steps of:

(i) determining if enough weapons of said selected weapon type are available to permit a weapon to be paired with each member of a target flight size associated with said target;

(ii) if enough weapons of said selected weapon type are not available, determining if enough weapons of a next selected weapon type are available;

(iii) repeating steps (i) and (ii) until it is determined that enough weapons of a selected weapon type or a next selected weapon type are available; and (v) determining if said weapons of said selected weapon type or said next selected weapon type can intercept each member of said target flight sized associated with said target.

10. A method for automatic weapon assignment, comprising the steps of:

(i) dividing a protected area into a plurality of defensive zones;

(ii) for each said defensive zone, providing a zone target priority knowledge database of possible mobile target types, said zone database including for each target type a set of particular weapon types in a prioritized arrangement, said target types being assigned a priority ranking;

(iii) for each said defensive zone, providing a target table of targets posing a threat to said zone;

(iv) selecting a defensive zone;

(v) for the selected defensive zone, selecting a target in said corresponding zone target table having a highest priority ranking;

(vi) performing an automatic weapon assignment process on said selected target, said process including selecting an available weapon for use against said target according to said prioritized arrangement in said zone target priority knowledge database for the selected zone, and performing a trial intercept calculation on said target using said selected weapon;

(vii) repeating steps (v) and (vi) for each target in said zone target table; and (viii) repeating steps (v), (vi) and (vii) for each zone until all zones have been processed.

11. The method of claim 10 wherein said automatic weapon assignment process of step (vi) further comprises determining whether said selected target has been neutralized by said selected weapon, selecting another available weapon for use against said target according to said prioritized arrangement, and performing a trial intercept calculation on said selected target using said another available weapon.

12. The method of claim 10, further comprising the step of adding newly detected targets posing a threat to a defensive zone to a corresponding zone target table, and removing from a zone target table any targets which have been neutralized or which exit said zone.

13. The method of claim 10 wherein said mobile targets are airborne targets.

14. An automatic weapon assignment system comprising:

a database of possible mobile target types, said database including for each said target type a set of weapon types in a prioritized arrangement, said target types being assigned a priority ranking;

a target table adapted for containing a target detected within a protected area;

a selection processor for selecting a detected target in said target table having a highest priority ranking; and an automatic weapon assignment processor responsive to said target table and to said database for selecting an available weapon for use against said selected target according to said prioritized arrangement.

15. The automatic weapon assignment system of claim 14 wherein said priority ranking is a function of at least one of said protected area, a track speed, a heading, an altitude, a flight size, an airframe type, and a weapons load associated with said target types.

16. The automatic weapon assignment system of claim 14 wherein said automatic weapon assignment processor comprises a trial intercept calculation processor for performing a trial intercept calculation on said detected target using said selected weapon.

17. The automatic weapon assignment system of claim 14 wherein said automatic weapon assignment processor further comprises a target neutralizer processor for determining whether said detected target has been neutralized by said selected weapon, wherein said automatic weapon assignment processor is operative to select another available weapon for use against said detected target according to said prioritized arrangement if it is determined that said detected target has not been neutralized by said selected weapon.

18. The automatic weapon assignment system of claim 14 further comprising a target control processor for adding to said table targets which are newly detected in said protected area and targets which become uncommitted against.

19. The automatic weapon assignment system of claim 14 further comprising a target control processor for removing from said table targets which exit said protected area, targets which become committed against and targets which are identified as friendly.

* * * * *